US007228578B2

(12) United States Patent
Linnane

(10) Patent No.: US 7,228,578 B2
(45) Date of Patent: Jun. 12, 2007

(54) DUVET COVER HAVING RELEASABLE EDGE FASTENERS AND INTERNAL POCKET AND FLAPS

(76) Inventor: Marie Linnane, 3 Orchard Rd., Southsea, Portsmouth, Hampshire (GB) PO4 0AA ( * ) Notice: Subject to any disclaimer, the term of this patent is extended or adjusted under 35 U.S.C. 154(b) by 51 days.

(21) Appl. No.: 10/505,330

(22) PCT Filed: Feb. 25, 2003

(86) PCT No.: PCT/GB03/00784

§ 371 (c)(1),
(2), (4) Date: Aug. 23, 2004

(87) PCT Pub. No.: WO03/070069

PCT Pub. Date: Aug. 28, 2003

(65) Prior Publication Data

US 2005/0144721 A1 Jul. 7, 2005

(30) Foreign Application Priority Data

Feb. 25, 2002 (GB) ..... 0204397.4

(51) Int. Cl.
*A47G 9/02* (2006.01)

(52) U.S. Cl. ..... 5/485; 5/502

(58) Field of Classification Search ..... 5/485, 5/489, 490, 491, 488, 501, 482, 486, 495, 5/497, 502, 699; 428/36.1, 137; 442/93
See application file for complete search history.

(56) References Cited

U.S. PATENT DOCUMENTS

| | | | | | |
|---|---|---|---|---|---|
| 2,058,428 | A * | 10/1936 | Dry | 5/604 |
| 2,358,410 | A * | 9/1944 | Matthesius | 2/69.5 |
| 2,821,723 | A * | 2/1958 | Gluck | 5/501 |
| 4,316,299 | A * | 2/1982 | Friedman | 5/485 |
| 5,226,193 | A * | 7/1993 | Chen | 2/69.5 |
| 5,321,861 | A * | 6/1994 | Dancey et al. | 5/482 |
| 5,787,527 | A * | 8/1998 | Anderson | 5/484 |
| 6,134,730 | A * | 10/2000 | Evanson | 5/482 |
| 6,243,896 | B1 * | 6/2001 | Osuna et al. | 5/502 |
| 6,539,565 | B1 * | 4/2003 | Trimble | 5/485 |
| 2004/0031098 | A1 * | 2/2004 | Hollander | 5/482 |
| 2004/0187210 | A1 * | 9/2004 | Hickman | 5/482 |

FOREIGN PATENT DOCUMENTS

| | | |
|---|---|---|
| DE | 1810372 A | 6/1970 |
| DE | 29510734 U | 11/1995 |
| GB | 2191088 A | 12/1987 |
| GB | 2272639 A | 5/1994 |
| GB | 2330302 A | 4/1999 |
| GB | 2331239 A | 5/1999 |
| GB | 2341089 A | 3/2000 |

* cited by examiner

*Primary Examiner*—Carl D. Friedman
*Assistant Examiner*—Gay Ann Spahn
(74) *Attorney, Agent, or Firm*—John V. Stewart

(57) ABSTRACT

A cover for a duvet (D) comprises an underside panel and an upperside panel (16), the underside and upperside panels being joined together along their top edges and part-way along their side edges, and a further panel (14) joined to the bottom edge and part-way along the side edges of the underside panel: the upperside panel (16) is provided, adjacent its bottom edge and side edges, with fasteners (20) to engage complementary fasteners (22) along the edges of the further panel (14).

3 Claims, 2 Drawing Sheets

DUVET COVER HAVING RELEASABLE EDGE FASTENERS AND INTERNAL POCKET AND FLAPS

BACKGROUND OF THE INVENTION

The present invention relates to a duvet cover.

Duvets are nowadays very popular and in widespread use. Generally, however, it is a relatively time-consuming and relatively difficult exercise to apply the usual cover to the duvet.

BRIEF SUMMARY OF THE INVENTION

I have now devised a duvet cover which is of simple construction yet easy to apply to a duvet.

In accordance with the present invention, there is provided a duvet cover for covering a duvet. The duvet cover comprises generally rectangular top and bottom panels of similar size, each of the panels having: a head edge; a foot edge; left and right side edges; a length between the head and foot edges; a width between the side edges; a head portion extending partly over the length of the panel from the head edge; and a foot portion extending partly over the length of the panel from the foot edge towards the head portion; wherein the head edges of the panels are joined together, the left edges of the head portions of the panels are joined together, and the right edges of the head portions of the panels are joined together. The duvet cover further comprises a pocket panel covering the foot portion of the bottom panel, the pocket panel having: a head edge; a foot edge; left and right side edges; a length between the head and foot edges substantially less than the length of the top and bottom panels; and a width between the side edges generally equal to the width of the top and bottom panels; wherein the foot edges of the pocket and bottom panels are joined together, and the left and right edges of the pocket panel are joined to the left and right edges, respectively, of the foot portion of the bottom panel. Fastening means are provided along the foot and side edges of the pocket panel for releasably fastening with complementary fastening means along the foot edge of the top panel and along the side edges of the foot portion of the top panel. In use, with the fastening means released, one end of the duvet can be inserted into the duvet cover between the pocket panel and the foot portion of the bottom panel, and an opposite end of the duvet can be inserted into the duvet cover between the head portions of the top and bottom panels; the top panel can then be flattened so that the foot portion of the top panel covers the pocket panel; and the fastening means can then be fastened.

The top and bottom panels preferably each have a mid portion between the respective head and foot portions, the left and right edges of the mid portion of the bottom panel not being joined to the pocket panel nor the top panel. In this case, the duvet cover preferably further has left and right flaps joined to the left and right edges of the mid portion of the bottom panel, whereby the flaps can be sandwiched between the duvet and the mid portion of the top panel. In use, these flaps can therefore be folded inwardly, over the upperside of the duvet, before the foot portion of the top panel is closed over the duvet and pocket panel. The flaps thus cover the otherwise-exposed edges of the duvet at those locations. The flaps may comprise separate pieces attached to the bottom panel, or may comprise extensions of the bottom panel.

DETAILED DESCRIPTION OF THE INVENTION

Figure 1:
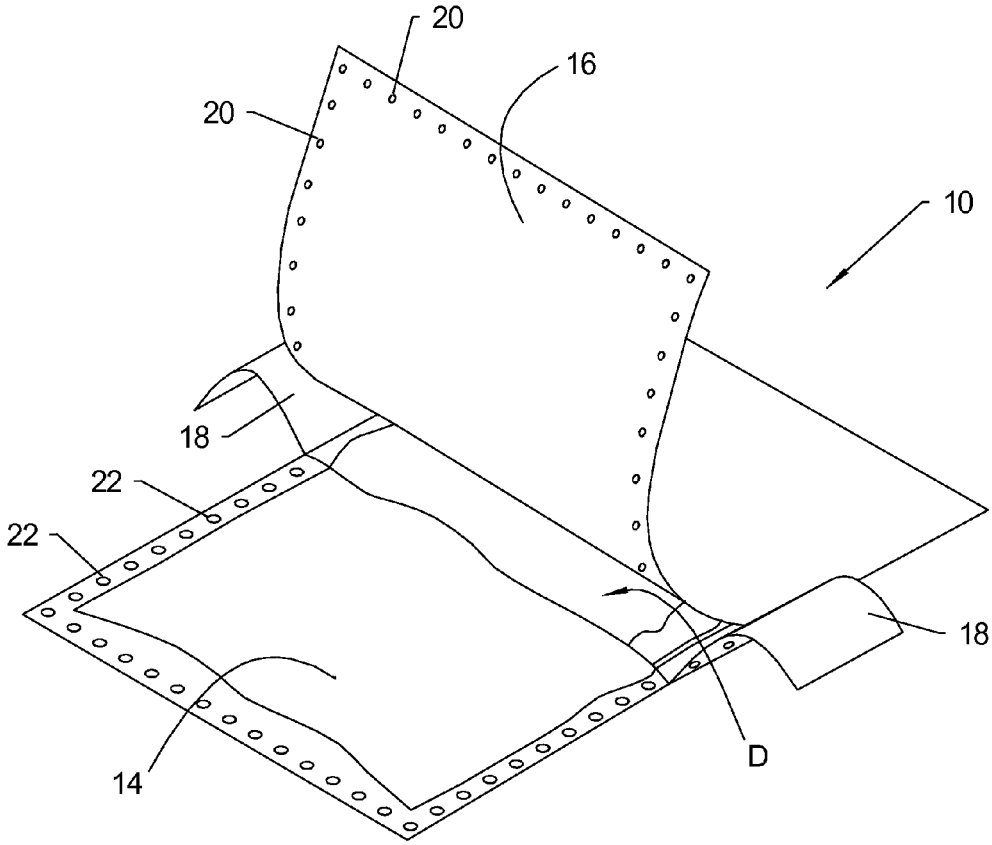
FIG. 1 is an isometric view of an embodiment of duvet cover in accordance with the invention, shown with the duvet inserted but prior to closure.

Referring to the drawings, there is shown a cover 10 for a duvet D. The cover comprises a rectangular underside panel 12 and a panel 14 which overlies the lower half of the underside panel 12, being joined to the underside panel along their bottom and side edges. The panel 14 forms, with the underside panel 12, an envelope which is open along its top edge, to receive the lower half of the duvet D.

The cover 10 further comprises a rectangular upperside panel 16 which overlies the underside panel 12 and the panel 14: the upperside panel 16 is joined to the underside panel 12 along their top edges and part way along their side edges, starting at the top and stopping before reaching the top edge of the panel 14. Flaps 18 are joined to the side edges of the underside panel 12, in the gaps between the top edge of the panel 14 and the point where the joins between the upperside panel 16 and the underside panel 12 stop: the flaps 18 are arranged to be folded inwardly, as shown in FIG. 2B. Adjacent the remainder of the side edges of the upperside panel 16, and adjacent its bottom edge, a series of fasteners 20 (e.g. pop studs) are provided, to engage a complementary series of fasteners 22 provided on the panel 14 and flaps 18, adjacent their bottom and side edges.

Figure 2A:
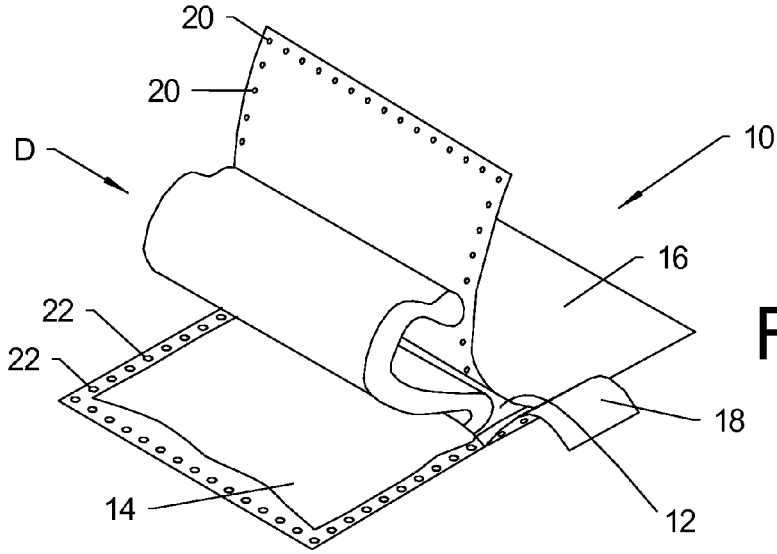
FIGS. 2A to 2C show the duvet cover of FIG. 1 at successive stages during the insertion of the duvet.
Figure 2B:
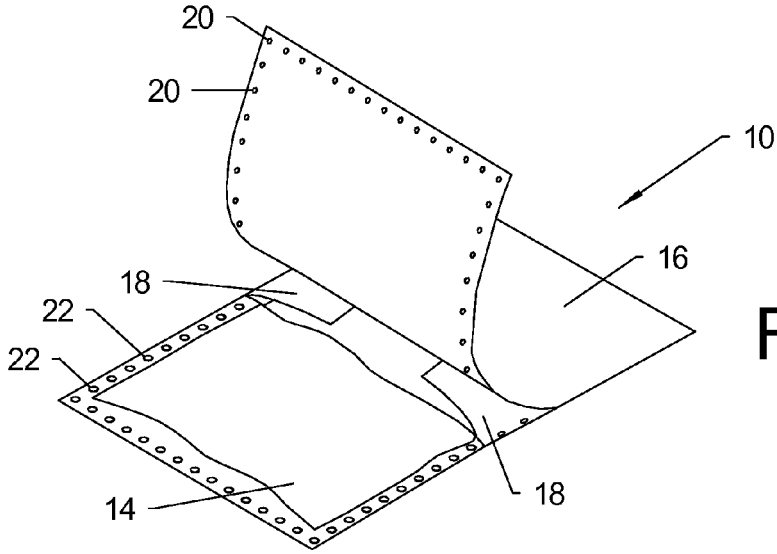
Figure 2C:
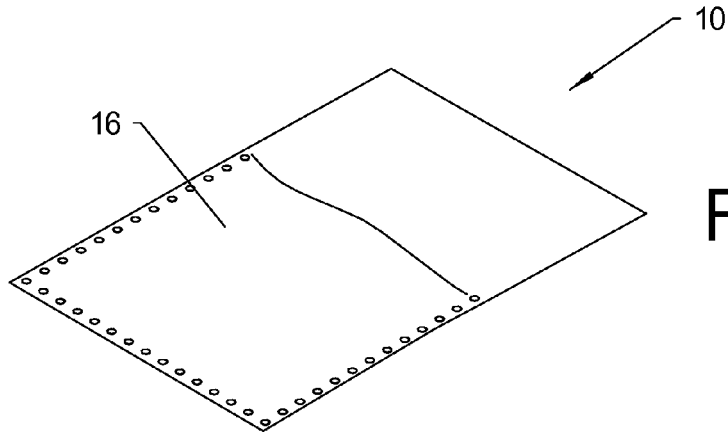

In use, and as shown in FIG. 2A, the upperside panel 16 is folded back towards the top of the cover and the flaps 18 are folded outwardly to the opposite sides of the cover. Then the bottom half of the duvet D is inserted into the envelope formed by the panel 14 and underside panel 12. Next the upper half of the duvet D is inserted into the envelope, provided at the top end of the cover, by the upperside panel 16 and underside panel 12: this stage is shown in FIG. 1. The flaps 18 are then folded inwardly, as shown in FIG. 2B, to lie on the upperside of the duvet D. Finally, the bottom half of the upperside panel 16 is laid over the panel 14 and fastened in position, along its side and bottom edges, using the fasteners 20, 22. FIG. 2C shows the cover 10 when fully closed about the duvet.

It will be appreciated that the duvet cover which has been described is of simple construction yet makes it particularly easy to apply to duvets.

The invention claimed is:

1. A duvet cover for covering a duvet, the duvet cover comprising:

generally rectangular top and bottom panels of similar size, each of the panels having: a head edge; a foot edge; left and right side edges; a length between the head and foot edges; a width between the side edges; a head portion extending from the head edge over only a portion of the length of the panel; and a foot portion extending from the foot edge over only a portion of the length of the panel so as to extend towards the head portion; wherein the head edges of the panels are joined together, the left edges of the head portions of the panels are joined together, and the right edges of the head portions of the panels are joined together;

a pocket panel covering the foot portion of the bottom panel, the pocket panel having: a head edge; a foot edge; left and right side edges; a length between the head and foot edges substantially less than the length of the top and bottom panels; and a width between the side edges generally equal to the width of the top and bottom panels; wherein the foot edges of the pocket and bottom panels are joined together, and the left and right edges of the pocket panel are joined to the left and right edges, respectively, of the foot portion of the bottom panel; and fastening means along the foot and side edges of the pocket panel for releasably fastening with complementary fastening means along the foot edge of the top panel and along the side edges of the foot portion of the top panel;

whereby:

with the fastening means released, one end of the duvet can be inserted into the duvet cover between the pocket panel and the foot portion of the bottom panel, and an opposite end of the duvet can be inserted into the duvet cover between the head portions of the top and bottom panels;

the top panel can then be flattened so that the foot portion of the top panel covers the pocket panel; and the fastening means can then be fastened.

2. A duvet cover as claimed in claim 1, wherein the top and bottom panels each have a mid portion between the respective head and foot portions, the left and right edges of the mid portion of the bottom panel not being joined to the pocket panel nor the top panel.

3. A duvet cover as claimed in claim 2, further having left and right flaps joined to the left and right edges of the mid portion of the bottom panel, whereby the flaps can be sandwiched between the duvet and the mid portion of the top panel.

* * * * *